US011072964B2

(12) United States Patent
Teta et al.

(10) Patent No.: US 11,072,964 B2
(45) Date of Patent: Jul. 27, 2021

(54) COMPACT HINGE ACTUATING DEVICE

(71) Applicant: Jeffrey Michael Teta, Hampstead, NC (US)

(72) Inventors: Jeffrey Michael Teta, Hampstead, NC (US); Keith Andrew Palumbo, East Northport, NY (US); Joshua Vaughn Dittrich, Somerville, MA (US)

(73) Assignee: Jeffrey Michael Teta, Hampstead, NC (US)

( * ) Notice: Subject to any disclaimer, the term of this patent is extended or adjusted under 35 U.S.C. 154(b) by 0 days.

(21) Appl. No.: 16/255,739

(22) Filed: Jan. 23, 2019

(65) Prior Publication Data

US 2019/0390503 A1 Dec. 26, 2019

Related U.S. Application Data

(63) Continuation-in-part of application No. 16/132,415, filed on Sep. 15, 2018.

(60) Provisional application No. 62/620,976, filed on Jan. 23, 2018.

(51) Int. Cl.

| | |
|---|---|
| ***E05F 15/72*** | (2015.01) |
| ***E05F 1/00*** | (2006.01) |
| ***E05D 11/00*** | (2006.01) |
| ***E05F 1/12*** | (2006.01) |
| ***E05F 15/614*** | (2015.01) |

(52) U.S. Cl.

CPC ..... *E05F 15/72* (2015.01); *E05D 11/00* (2013.01); *E05F 1/006* (2013.01); *E05F 1/1207* (2013.01); *E05F 15/614* (2015.01); *E05Y 2201/434* (2013.01); *E05Y 2400/32* (2013.01); *E05Y 2400/44* (2013.01)

(58) Field of Classification Search

CPC .. E05D 11/10; E05D 3/02; A62C 3/14; A62C 2/241; E05F 1/006; E05F 1/1207; E05F 15/614; E05F 15/72

See application file for complete search history.

(56) References Cited

U.S. PATENT DOCUMENTS

| | | | | | |
|---|---|---|---|---|---|
| 2,520,536 | A * | 8/1950 | Feeley | A62C 2/242 | 16/222 |
| 2,591,476 | A * | 4/1952 | Swanson | E05D 11/1064 | 16/54 |
| 3,559,232 | A * | 2/1971 | Crane | E05F 3/16 | 16/50 |
| 3,699,608 | A * | 10/1972 | Schwarz | E05F 17/00 | 16/79 |

(Continued)

*Primary Examiner* — Jeffrey O'Brien

(74) *Attorney, Agent, or Firm* — Collard & Roe, P.C.

(57) ABSTRACT

A compact hinge actuating device comprising at least one hinge comprising at least one hinge plate and at least one knuckle. In one embodiment there is at least one sensor and/or fuse element coupled to said at least one hinge and at least one microprocessor coupled to the at least one hinge. There is also at least one drive coupled to the at least one hinge, wherein when the sensor receives input of a condition, and/or the fuse fails then the drive can be actuated. In the electronic version, the microprocessor reads the input as exceeding a minimum threshold value of a predetermined condition, the microprocessor then triggers the at least one drive to close or open the at least one hinge. In at least one embodiment the drive can be a spring, in another embodiment the drive can be a solenoid.

6 Claims, 16 Drawing Sheets

(56) References Cited

U.S. PATENT DOCUMENTS 3,777,423 A * 12/1973 Coulter ..... E05F 3/222 49/31
3,905,063 A * 9/1975 Coulter ..... A62C 2/12 16/48.5
3,908,309 A * 9/1975 Coulter ..... E05F 3/222 49/31
4,102,013 A * 7/1978 Newlon ..... E05D 5/128 16/222
4,141,123 A * 2/1979 Newlon ..... E05D 5/128 29/11
4,339,845 A * 7/1982 Newlon ..... E05F 1/1215 16/300
4,583,262 A * 4/1986 Werner ..... E05F 1/1215 16/300
4,726,613 A * 2/1988 Foshee ..... E05B 65/104 292/150
5,058,236 A * 10/1991 Henson ..... E05D 7/0027 16/222
5,121,950 A * 6/1992 Davidian ..... E05B 65/104 292/164
5,652,563 A * 7/1997 Maus ..... A01K 29/00 119/773
5,864,920 A * 2/1999 Lasson ..... F15B 21/06 16/79
6,481,160 B1 * 11/2002 Kowalczyk ..... E05F 3/224 49/333
7,367,161 B1 * 5/2008 Jones ..... E05F 15/614 49/334
8,169,169 B2 * 5/2012 Hass ..... E05F 15/63 318/286
8,375,519 B1 * 2/2013 Cooper ..... E05F 1/006 16/319
8,955,194 B2 * 2/2015 Teta ..... E05F 1/1207 16/48.5
10,626,651 B2 * 4/2020 Chang ..... E05F 3/20
10,808,447 B2 * 10/2020 Docksteader ..... G08B 3/10
2013/0205670 A1 * 8/2013 Springborn ..... E05F 15/611 49/358
2017/0292308 A1 * 10/2017 Beran ..... E05F 3/20
2018/0283078 A1 * 10/2018 Damboragama ..... E05F 15/611
2018/0305969 A1 * 10/2018 Docksteader ..... E05F 1/12
2019/0330903 A1 * 10/2019 Talpe ..... E05F 3/12
2019/0376332 A1 * 12/2019 Chi-Hsueh ..... E05D 3/02
2020/0173213 A1 * 6/2020 Bucklin ..... E05F 1/1207
2020/0177051 A1 * 6/2020 Abe ..... H02K 7/1853
2020/0224482 A1 * 7/2020 Sellinger ..... G08B 3/10
2021/0025215 A1 * 1/2021 Sellinger ..... E05F 15/63
2021/0032923 A1 * 2/2021 Docksteader ..... E05F 15/72

* cited by examiner

SECTION B-B

FIG. 8A
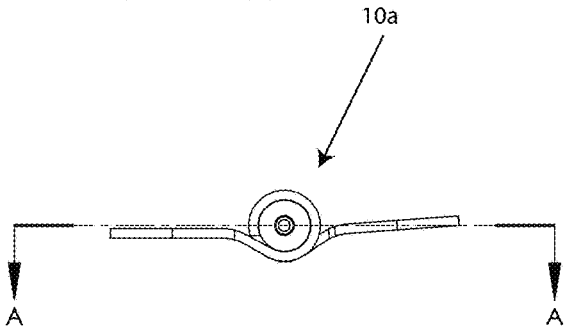
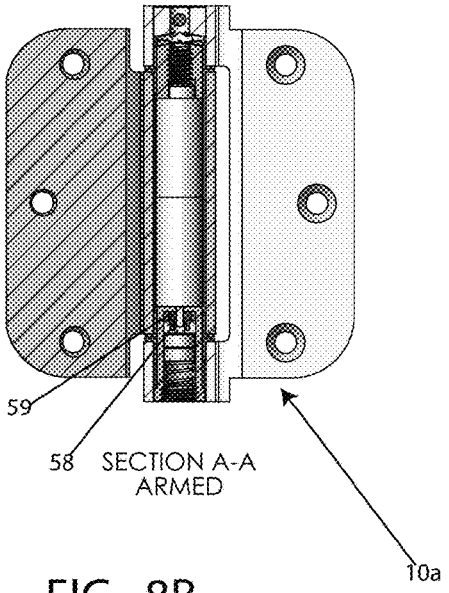
FIG. 8B
FIG. 8C
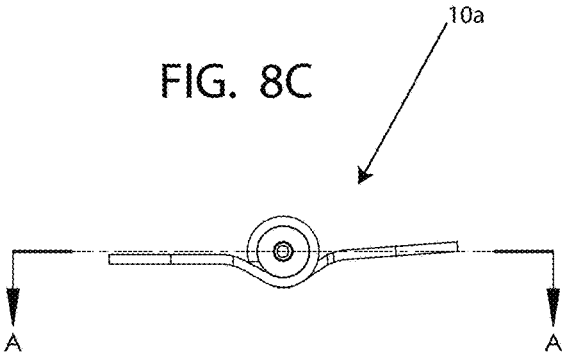
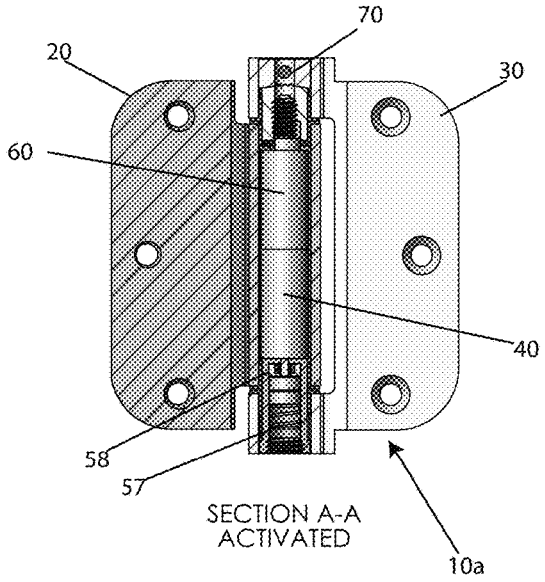
FIG. 8D

COMPACT HINGE ACTUATING DEVICE

CROSS REFERENCE TO RELATED APPLICATIONS

This application is a non-provisional application that claims priority from provisional application Ser. No. 62/620,976 filed on Jan. 23, 2018, this application is also a continuation in part application that claims priority from U.S. patent application Ser. No. 16/132,415 filed on Sep. 15, 2018, the disclosure of both of these applications hereby incorporated herein by reference in their entirety.

BACKGROUND OF THE INVENTION

At least one embodiment of the invention relates to a compact automatic electronic hinge closing device which is configured to automatically activate an opening such as a door. For example, in the case of a fire or a situation with an elevated temperature, it may be beneficial to activate/close or open a door to shut off a space in a building from the ingress of fire or aid in the ventilation control. With the presence of an automatic electronic hinge closing device, a door can be closed in anticipation of the spread of harmful gasses such as smoke or fire. In addition, it would be beneficial to have the door opened or closed or other reasons such as security, convenience, thermal or environmental reasons or to aid those with a disability.

SUMMARY OF THE INVENTION

At least one embodiment comprises a compact automatic electronic hinge actuating device comprising at least one hinge comprising at least one hinge plate and at least one knuckle at least one sensor coupled to said at least one hinge. There is also at least one microprocessor coupled to the at least one hinge and at least one drive coupled to the at least one hinge, wherein when the sensor receives input of a condition, and the microprocessor reads the input as exceeding a minimum or maximum threshold value of a predetermined condition, the microprocessor triggers the at least one drive to actuate the at least one hinge.

In at least one embodiment there is at least one memory for storing at least one minimum threshold value of a predetermined condition.

In at least one embodiment there is at least one transceiver for allowing communication from the electronic system to other electronic devices.

In at least one embodiment the hinge is configured to be coupled to at least one door and to at least one frame wherein the drive on the hinge is configured to drive the at least one door to a closed or open position when the microprocessor reads the input as exceeding a minimum threshold value of a predetermined condition.

In at least one embodiment, there is a heat activated element that when triggered activates a solenoid thereby releasing a spring element to activate the hinge.

In at least one embodiment the sensor can be any one of an audio sensor, a heat sensor or a smoke sensor.

In at least one embodiment there is a first sensor that determines whether the door is open, closed, or being opened or closed and assists the user in applying toque to the door to aid in closing or opening the door.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views:

FIG. 8A is an end view;

FIG. 8B is a side cross-sectional view taken along the line A-A of FIG. 8A;

FIG. 8C is an end view; and

FIG. 8D is a side cross-sectional view taken along line A-A of FIG. 8C;

DETAILED DESCRIPTION OF PREFERRED EMBODIMENTS

Figure 1:
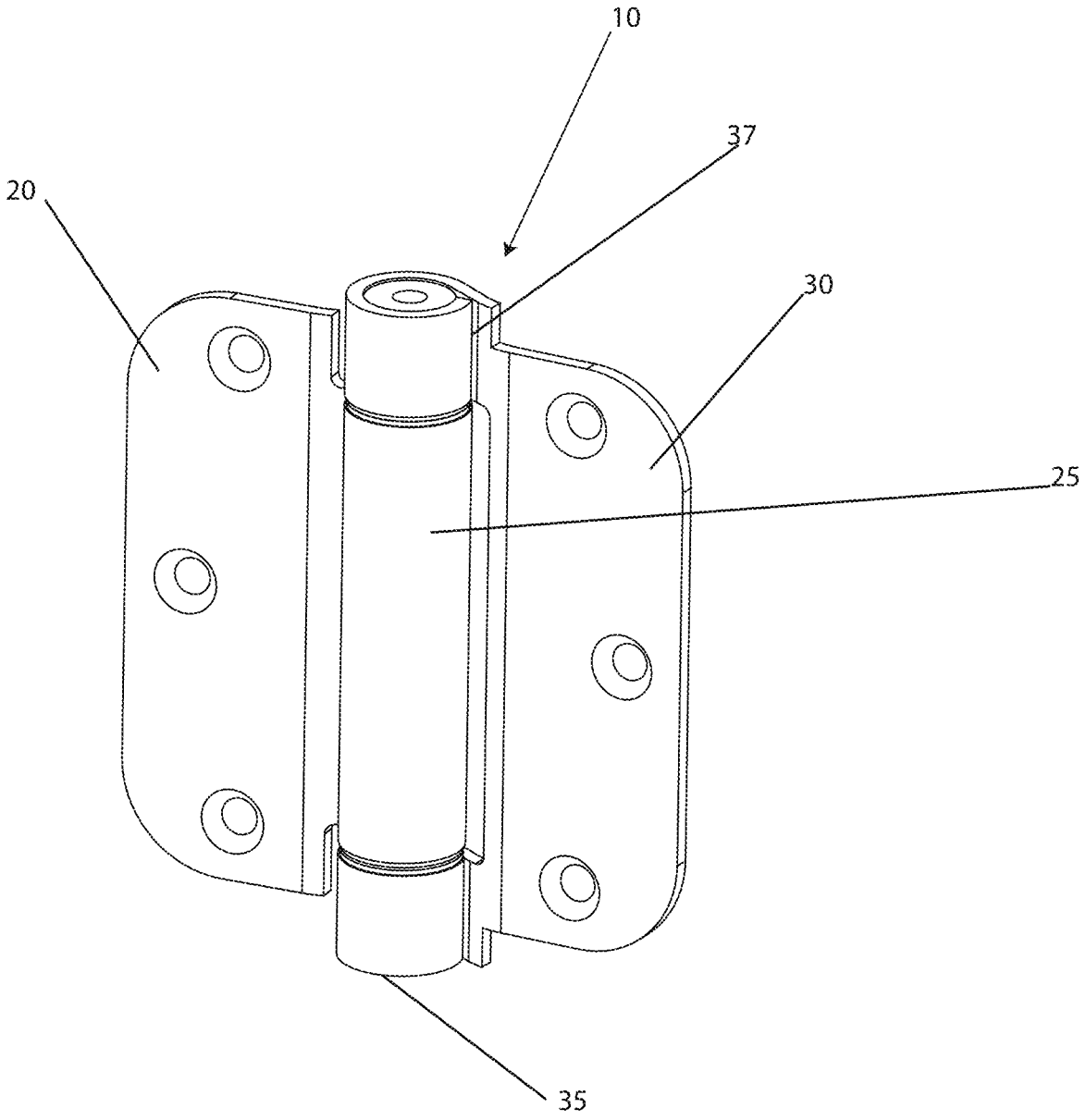
FIG. 1 is a perspective view of the device.

Referring to the drawings, FIG. 1 is a side perspective view of an embodiment of the invention which includes a compact automatic hinge activation device 10 which includes a first hinge 20 having a knuckle 25, and a second hinge 30 having knuckles 35 and 37.

Figure 2A:
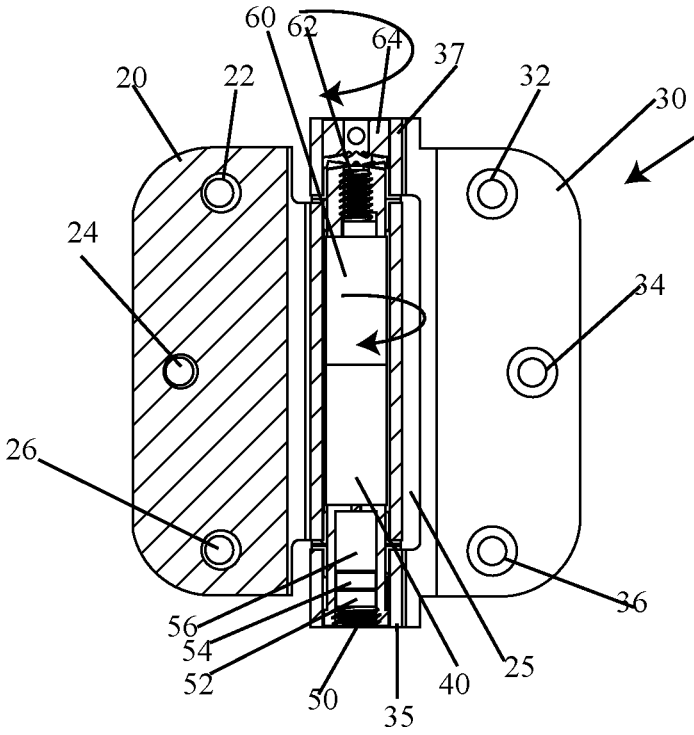
FIG. 2A is a side cross-sectional view of a first embodiment.

FIG. 2A shows a side view of a first embodiment of the invention comprising an automatic hinge closure device 10 comprising at least two hinge plates 20 and 30 which are coupled together. Each hinge plate such as hinge plate 20 has holes 22, 24, and 26, which are drill holes and which are designed to be coupled via a fastening device such as a nail or screw to an adjacent object such as a door. With hinge plate 30 there are also holes 32, 34, and 36 which can be used to allow the device to be coupled to an adjacent object such as a door frame.

Each of the hinge plates such as hinge plate 20 has at least one knuckle such as knuckle 25. Knuckle 25 serves as a cylindrical housing for components for the automatic activation device. In addition, knuckles 35 and 37 are also configured to be coupled to hinge plate 30 and also to be coupled to either end of knuckle 25.

The internal components inside of the knuckles 25 and 35 and 37 are configured to drive the hinge to close or open an opening such as a door.

For example, there is a first set screw 50 which is configured to set the components inside of these knuckles. Adjacent to set screw 50 are batteries 52 and 54. Adjacent to batteries 52 and 54 is a pivot pin housing 56 forming a triggering module which houses at least one sensor. In at least one embodiment, the sensor can be in the form of a thermal sensor, a smoke alarm sensor, a resonant frequency trigger, a heat sensor, or any other suitable ambient sensor which can be used to detect a condition surrounding the hinge that a user would want the hinge to activate or actuate.

In addition, there are also housings comprising a motor 40 and a gear box 60. Housing 56 is configured to house drive 99 or any one of the sensors such as audio reader 101 which functions as a resonant frequency trigger or as an audible decibel trigger, a heat sensor 105, or a smoke sensor 103. (See FIG. 3). Drive 99 can utilize a small, low voltage DC motor coupled to high reduction gearbox to actuate the door. The audio reader 101 can be in the form of a resonant frequency trigger which is configured to trigger based upon an audible signal from smoke detectors, etc.). Housing 56 can be formed integral with motor 40. Alternatively, audio reader 101 can be activated based upon a voice command from a user which then causes audio reader 101 to send a signal to microprocessor 106 to instruct the drive 99 to actuate the hinge.

Figure 2B:
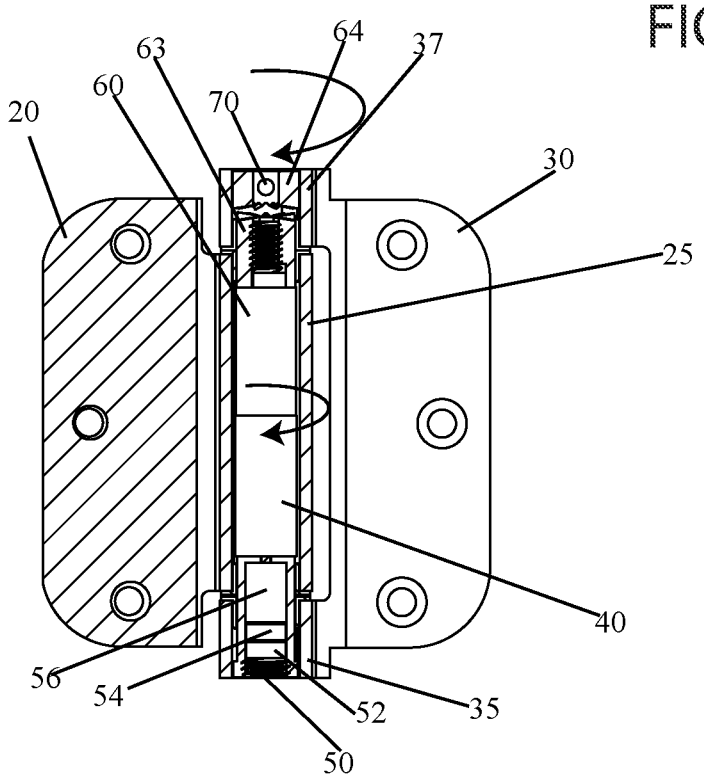
FIG. 2B is another side cross-sectional view of the first embodiment.

Disposed adjacent to gear box 60 is an output shaft 61. Coupled to output shaft 61 is drive shaft 62. Coupled to drive shaft 62 is housing 63, wherein drive shaft 62 and housing 63 form a Bendix gear having drive teeth. This Bendix gear is configured to mesh with an adjacent drive dog 64, which is fixed to the knuckle 37 via a set screw or pin 70 (See FIG. 2B).

Thus, ultimately the drive such as drive 99 is configured to drive the Bendix gear to cause the gear to mesh with the adjacent drive dog 64 to drive hinge plate 30 to close or open with respect to hinge plate 20.

This type design can also be used with other suitable drive and/or clutch type systems such as that disclosed in U.S. patent application Ser. No. 16/132,415 filed on Sep. 15, 2018 the disclosure of which is hereby incorporated herein by reference in its entirety.

Figure 3:
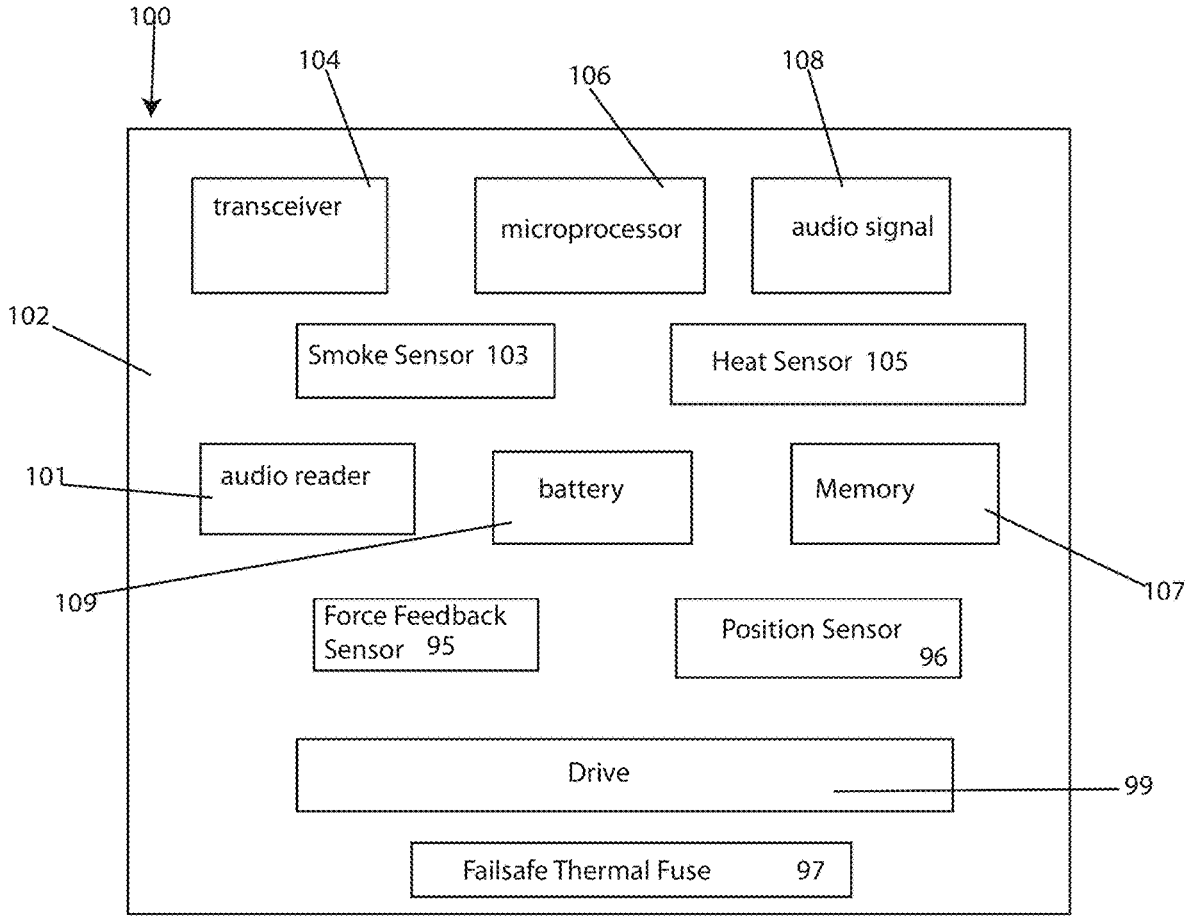
FIG. 3 is a schematic block diagram of the first embodiment.

FIG. 3 shows some additional components that are configured to be embedded within the system. For example, there is a schematic block diagram of a controller 100 which includes a motherboard or bus system 102 for allowing the different electronic components to be powered by a power supply such as batteries or hard-wired power 109 and to allow the different electronic components to communicate with each other. The device can include a transceiver 104 which is configured as an ethernet or other wired based communication module or wifi and/or Bluetooth transceiver which allows for communication between this hinge closure system and an adjacent or remote electronic device such as a computer or a smart phone. This transceiver allows for two-way communication such that the drive system can be controlled remotely by a smartphone or a computer by receiving instructions from the smartphone or computer or it can send a signal to a smartphone or computer that it is in operation and current status such as position and last movement of the hinge. The device can be turned on or off remotely such as from a phone or a web app or from a building control system.

In addition, this transceiver 104 can be configured to receive either wireless or wired signals from an adjacent smoke or fire alarm such that when the smoke or fire alarm is triggered it sends a signal to the transceiver 104 to control the drive 99 to close the hinges 20 and 30 together to close the door.

Transceiver 104 can also be configured to remotely control other doors or hinges based upon information received into the hinge. For example, when this device receives information into one of the sensors such as any one of audio reader 101, heat sensor 105 or smoke sensor 103 or via communication from an external source into transceiver 104, microprocessor 106 can then read this information, selectively issue an audio signal via audio signal 108, to warn occupants and then communicate with other devices to either open or close doors or to send out a notification signal by transmitting a signal from transceiver 104 to other devices. Microprocessor 106 can be any suitable microprocessor configured to perform a series of steps or instructions. The information fed to and from the microprocessor 106 can be fed into memory 107. Memory 107 can be any form of suitable memory such as EEProm, flash memory or any other suitable memory that can serve as RAM and/or ROM for the system. Memory 107 can store variables which set forth predetermined conditions for selectively closing or opening a door. The predetermined conditions can be in the form of a minimum or maximum threshold value which is representative of the predetermined condition. Some of these predetermined conditions can be in the form of a pre-set temperature which is read by the heat sensor 105, a pre-set condition to be read by smoke sensor 118, a pre-set condition to be read by the audio signal 108 in the form of audible frequency of a signal or decibel level of a signal etc. Once this predetermined condition is reached, microprocessor 106 which is fed instructions from memory 107, can then operate the device 10 by either triggering drive 99 or signaling other devices. In addition, there is also disclosed a force feedback sensor 95 configured to determine if the user is currently opening or closing a door, and a position sensor 96 which both of which are configured to communicate with microprocessor 106 and supply torque in a direction that assists the user in opening or closing the door. Furthermore, the torque position sensor can be configured to actuate the door so that it allows the user to actively dampen the closure of the door to prevent slamming of the door, incomplete closing, or closing of the door on a user. While numerous different electronic components are shown, the controller 100 in its simplest form can simply comprise at least one microprocessor 106. In at least one embodiment the controller is simply a microprocessor 106 coupled to at least one sensor. In another embodiment, the controller 100 comprises microprocessor coupled to a memory such as memory 107, as well as coupled to a transceiver such as transceiver 104.

Figure 4:
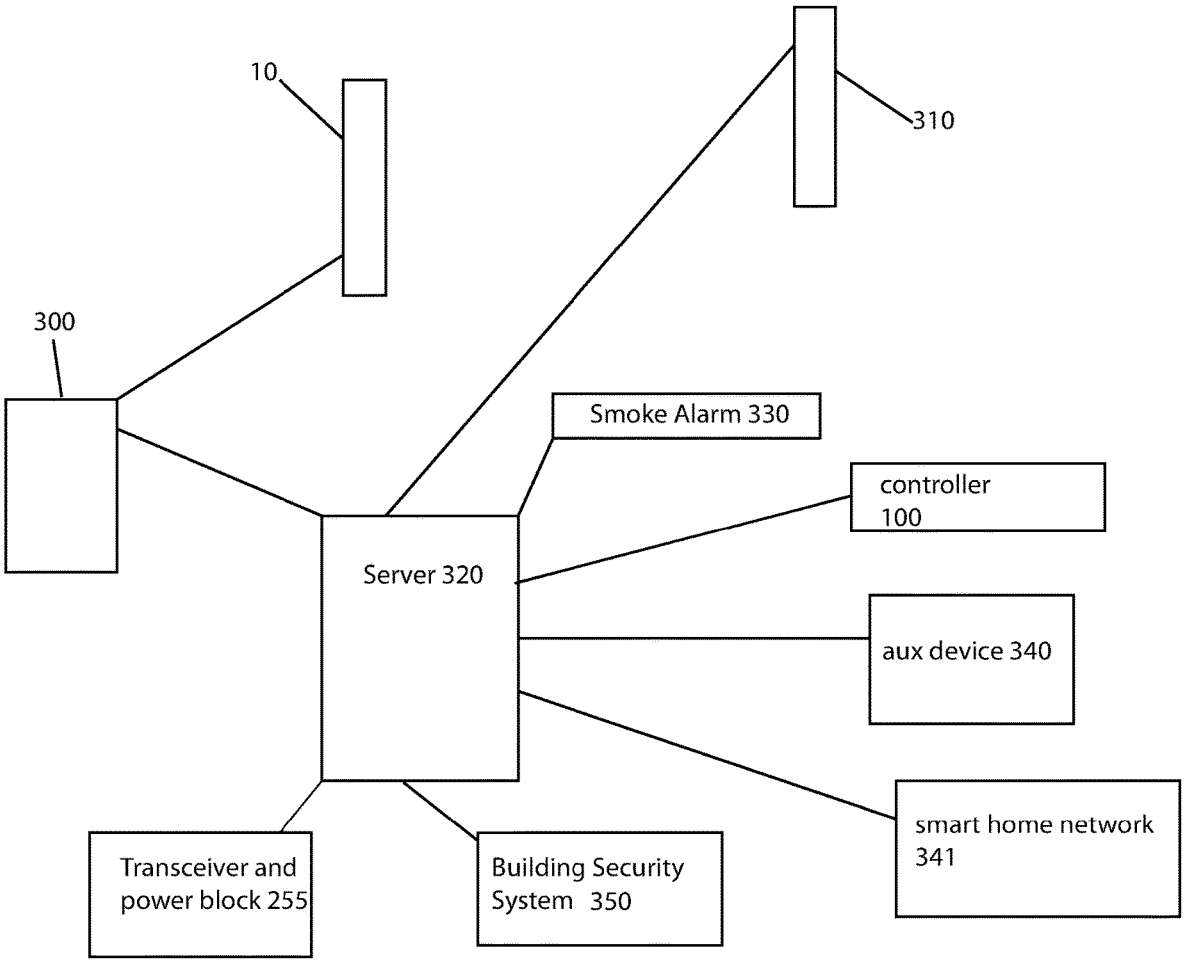
FIG. 4 is a schematic block diagram of different electronic components in communication with the device.

For example, FIG. 4 shows a network of devices such as hinge closure device 10 including a controller 100 which is configured to be in communication with another suitable electronic device such as a portable electronic device such as a smartphone 300 or a server 320, another door closure device 310, a smoke alarm 330, or an auxiliary device 340. Auxiliary device 340 can be any other suitable auxiliary device such as an HVAC system or a window closing device or lights. Thus, depending on signals received into hinge closure device 10 the device can then communicate with server 320, or directly via Bluetooth to an adjacent smartphone 300 to send or receive a series of instructions. For example, if a predetermined condition is reached, device 10 can notify server 320 directly or notify smartphone 300 via Bluetooth communication. The information can then be relayed either through server 320 or from phone 300 to server 320 to the remaining other components thereby creating a compact smart system that is interactive with other components. In addition, connected to this network is also a building security system 350 which is configured to communicate with server 320 to control hinges or alarms as well. The device can also include a warning light 214 and/or a noise activation device 213 (loudspeaker) as well as a microphone 212 as well (See FIG. 12A), which can be positioned on the hinge to indicate to the user that the hinge is being activated. There can also be a "smart home" system or network 341 which is configured to selectively activate the hinge as well. Alternatively, and as shown, controller 100 is shown separately if controller 100 is used with an alternative embodiment. Each of the embodiments shown below can be selectively equipped with a controller 100.

Figure 5A:
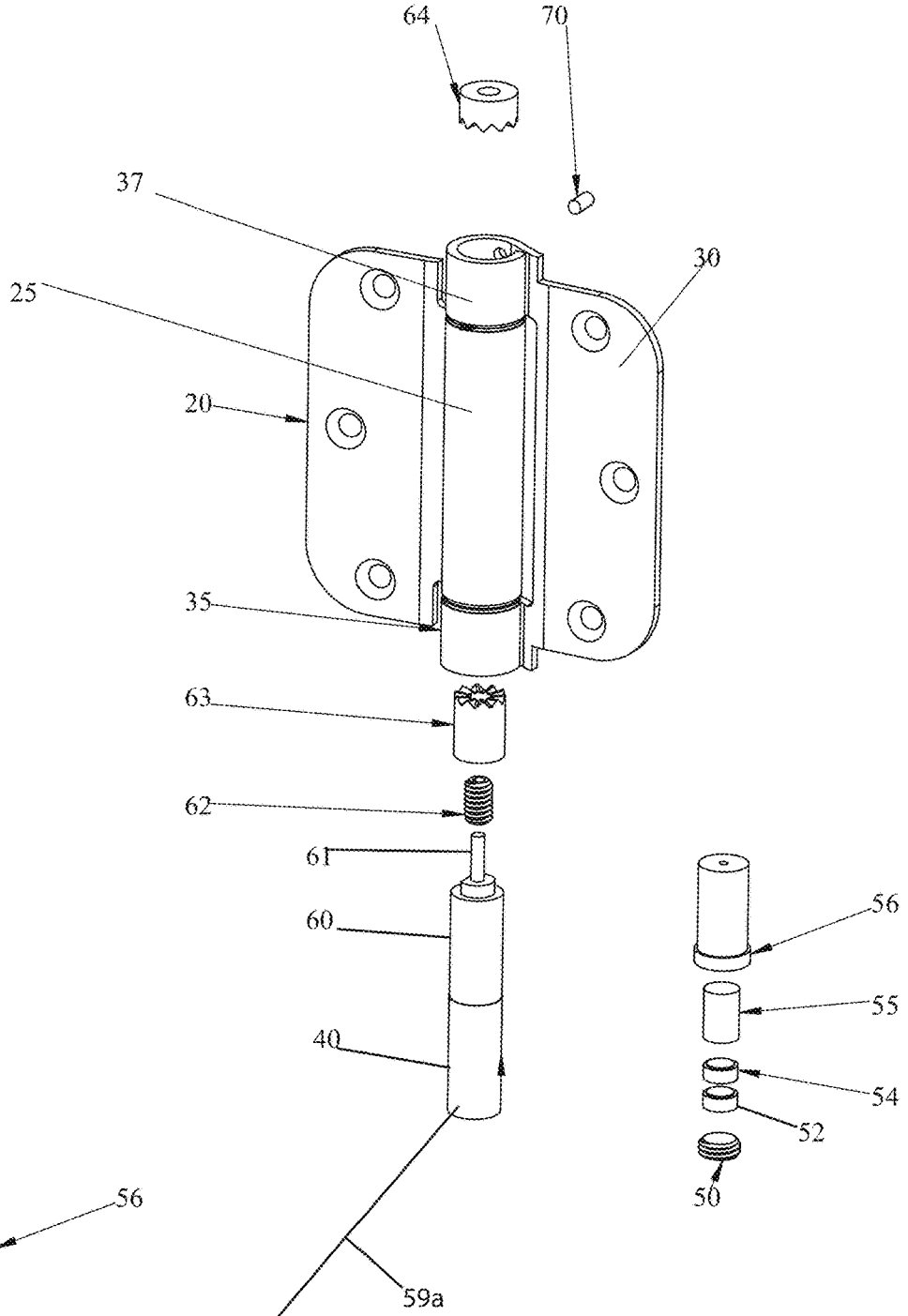
FIG. 5A is an exploded view of the device.

FIG. 5A is an exploded perspective view of the device. For example, there is shown the device having hinge plates 20 and 30 coupled together with knuckles 25, 35 and 37. At both ends are drive dogs 63 and 64, with drive dog 63 being a Bendix drive dog. A Bendix drive shaft 62 is positioned adjacent to drive dog 63. Motor 40, gear box 60 and shaft 61 comprise a gear motor which has a narrower cylinder or output shaft 61 coupled to Bendix drive shaft 62. A set screw or pin 70 is positioned to be placed inside of a hole in knuckle 37. In addition, there is a lower pivot pin housing 56, an electronics housing 55 housing a controller 100 (See FIG. 3) which is essentially controller 100 disposed therein, batteries 52 and 54, as well as an end cap. Batteries 52 and 54 power controller 100 so that controller 100 can selectively actuate motor 40 to actuate the hinge.

Figure 5B:
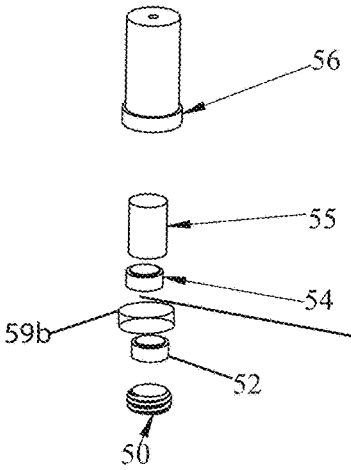
FIG. 5B is another embodiment of a fail safe device.

FIG. 5B shows another embodiment which includes a bypass line 59*a* and a fuse 59*b*. Bypass line is 59*a* configured to bypass housing 55 and controller 100 to provide power to motor 40 to directly actuate the motor when fuse 59*b* is actuated. Thus, when the heat is high enough to destroy controller 100, fuse 59*b* collapses allowing battery 52 to contact bypass line 59*a* to then provide power to motor 40. Bypass line 59*a* is otherwise isolated from battery 54 so that before fuse 59*b* collapses, power does not flow from battery 54. However, once fuse 59*b* collapses battery 52 contacts bypass line 59*a* to power motor 40.

Figure 6A:
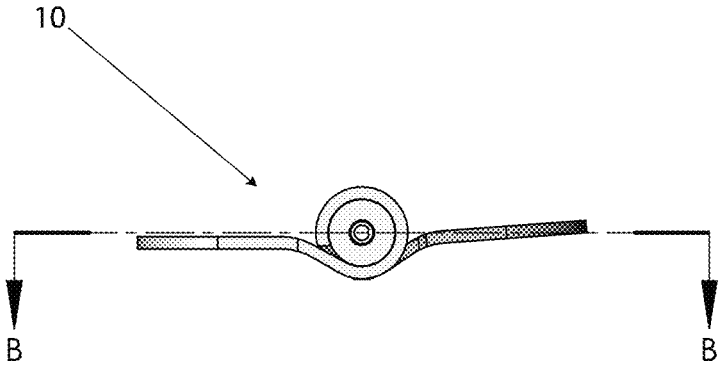
FIG. 6A is an end view of the device.
Figure 6B:
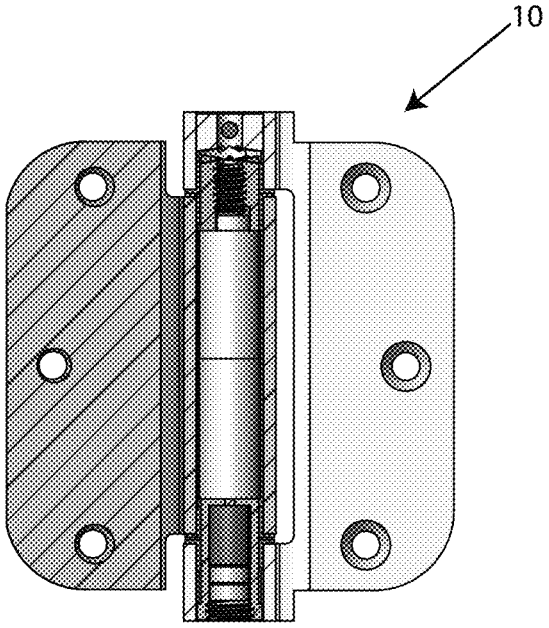
FIG. 6B is a side cross sectional view.

FIG. 6A shows a side view of the device 10 while FIG. 6B shows a cross-sectional view taken along the line B-B which shows the different parts of the device shown in FIG. 5 in an assembled position.

Figure 7:
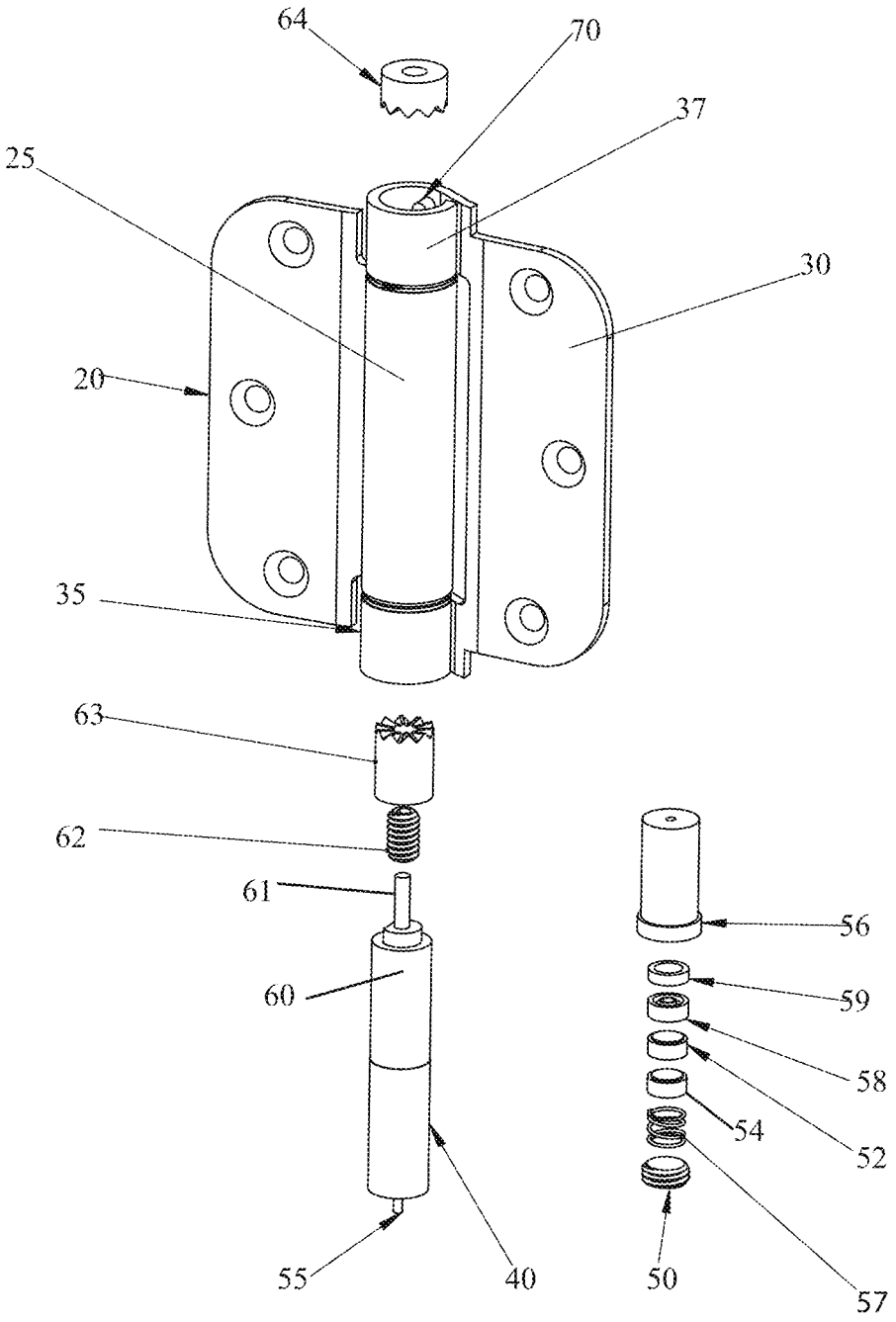
FIG. 7 is an exploded view

FIG. 7 is a perspective view of the device which is similar to the device shown in FIG. 5. For example, there is shown hinge plates 20 and 30 having associated knuckles 25, 35 and 37. Pin 70 is placed inside of knuckle 37. Bendix Gear 62 is positioned adjacent to shaft 61, and gear motor 40 and 60 which includes a motor 40 and a gear box 60 coupled to shaft 61. Gear box 60 drives shaft 61 which drives Bendix drive shaft 62, driving housing 63, thereby driving drive dog 64 from an open position to a closed position. Drive dog 64 is fixed to a knuckle 37 via pin 70. Thus, when drive dog 64 is driven by housing 63 having teeth, it thereby causes plate 30 to rotate to a closed position thereby approaching plate 20. Thus, when the hinge is coupled to a door and a respective door frame, it can be selectively triggered to close a door.

Positioned adjacent to motor 40 is a motor electrode pin 55*a* which is configured to be coupled to lower pivot pin housing 56. Positioned adjacent to lower pivot pin housing is fuse ring 59, an insulator cup 58, batteries 52 and 54, as well as a battery pre-load spring. An end cap 72 can be used to screw in and fasten batteries 52 and 54 into the pivot pin housing 56. Essentially with this device, when the temperature reaches above a certain level fuse ring 59 melts thereby causing batteries 52 and 54 to be driven axially towards the motor of the gear motor 40 thereby causing the batteries to be electrically connected to the gear motor 40. This then causes the gear motor to be engaged and then to drive the rotatable portion of the gear motor to cause the hinge to rotate from a first position to a second position.

FIG. 8A is an end view of the device while FIG. 8B is a side cross-sectional view of the device 10A which is a modified view of the device shown in FIG. 7. With this device, the hinge is in an armed position, with the fuse ring 59 separating the batteries from the gear motor. In this view, as also shown in FIG. 8B, the Bendix gear is disconnected leaving the hinge free to pivot.

FIG. 8C shows a side cross-sectional view of the device 10A again wherein FIG. 8D shows the view taken along the line A-A. In these views the fuse ring 59 has melted thereby driving via spring 57 batteries 52 and 54 up into gear motor 40 thereby creating an engagement of the device. With this engagement gear motor 40 is activated and now powered by batteries 52 and 54 electrically coupling with gear motor 40 thereby driving hinge plate 30 into a closed position.

Figure 9:
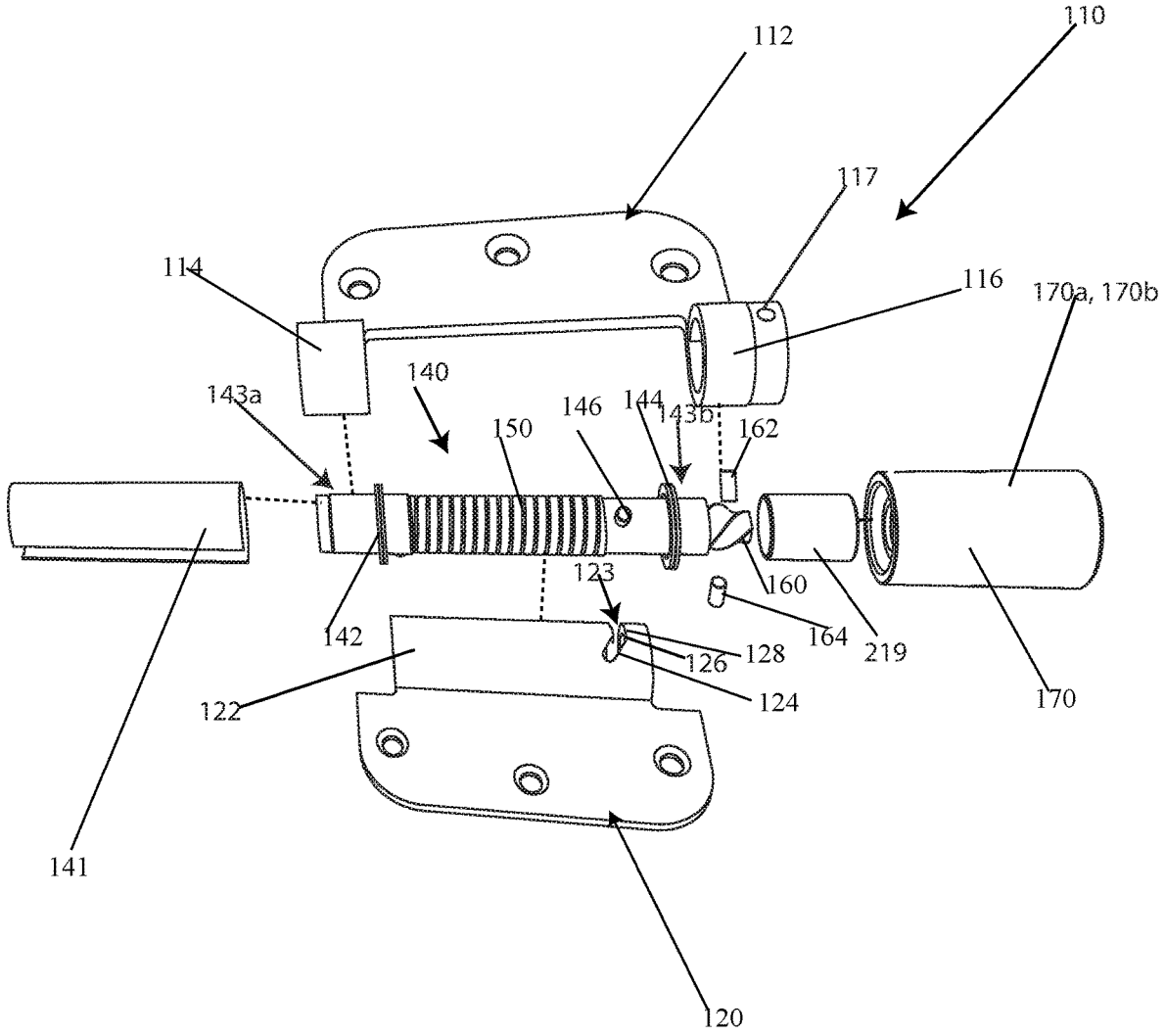
FIG. 9 is a side exploded view of another embodiment.

FIG. 9 is a side view of another embodiment. This embodiment is similar to the embodiment of U.S. application Ser. No. 16/132,415 filed on Sep. 15, 2018. This view shows a further exploded view of the device which shows hinges 112 and 120 which shows hinge 112 having knuckles 114 and 116 with hole 117 in knuckle 116. It also shows hinge 120 with knuckle 122 having groove 123 with angled section 124 and horizontal section 128. There is a cover 141 for body section 140 wherein cover 141 has a slot to receive hinge 120. Cover 141 covers over the different sections of body section 140. For example, there is a first end section 143*a* and a second opposite end section 143*b* and a pin 146. A spring 150 is coupled to the body section 140 between the end sections 143*a* and 143*b*. Coupled to the main body 140 is a gear 160. The gear 160 can be in any form however in at least one embodiment is in the form of a tapered worm gear or self-threading screw. Disposed adjacent to worm gear 160 are locking pins 162 and 164 which fit inside of respective holes 117 on knuckle 116. Positioned in a region of first section 143*a* is a first set of bearings 142, while at the second end section 143*b* are a second set of bearings 144.

End section 170 is shown with bushing 219 disposed adjacent to it. Bushing 219 is configured to fit inside of knuckle 116 and 122.

Figure 10:
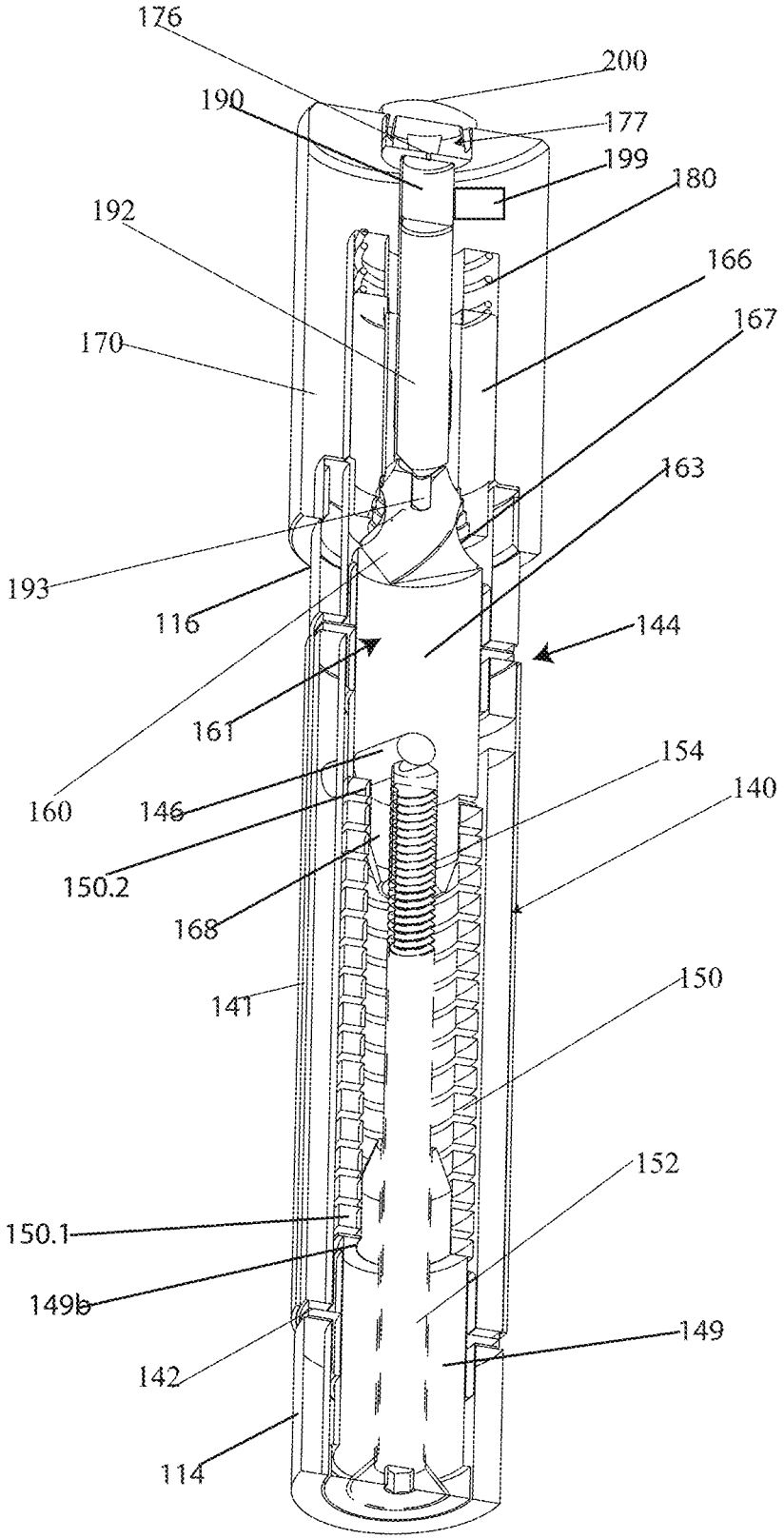
FIG. 10 is a side cross-sectional view of the embodiment of FIG. 9.

FIG. 10 is a side cross-sectional view of the hinge body and end section of a first embodiment. With this view there is main body section 140 having cover 141, spring 150 disposed inside cover 141 a bolt 152 having a threaded shaft section 154, a main body section 163 of gear block 161. Pin 146 is shown extending into main body section 163, into hole 169 (See FIG. 6A). Gear 160 is shown coupled to body section 163, and is configured to receive drive pin 192, particularly pointed section or tip 193 which inserts into a top section of gear 160. Gear 160 fits inside of contoured section 167 of receiving bushing 166. Gear block 161 receives the threaded section 154 of bolt 152 in threaded region 168. As shown receiving housing houses drive pin 192, while an electronically collapsible block 190 fits inside of section 175 of end section 170. The electronically collapsible block can take the place of a fuse which then allows the drive pin 192 to slide up under pressure from spring 150 which then allows the gear 160 to be engaged and to selectively open or close the hinge. In addition, coupled to the selectively collapsible block 190 is an additional block 199 which includes a transceiver for wireless communication and a power pack comprising a battery. The selectively collapsible block can comprise a solenoid which collapses on itself which shrinks the block on itself to selectively shrink the size of the block to allow the gear to 160 to be engaged.

Figure 11A:
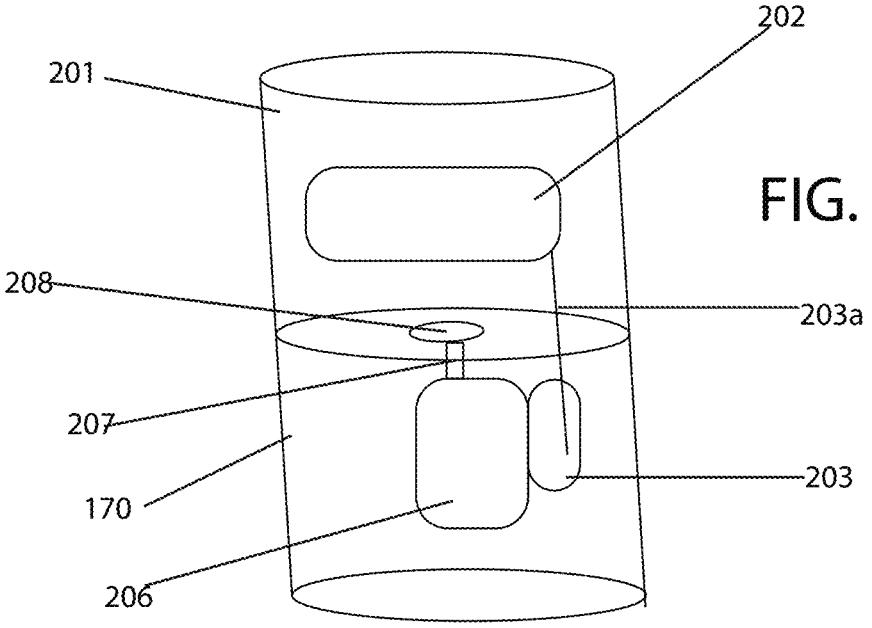
FIG. 11*a* is a side view of a one embodiment of the electronic devices.
Figure 11B:
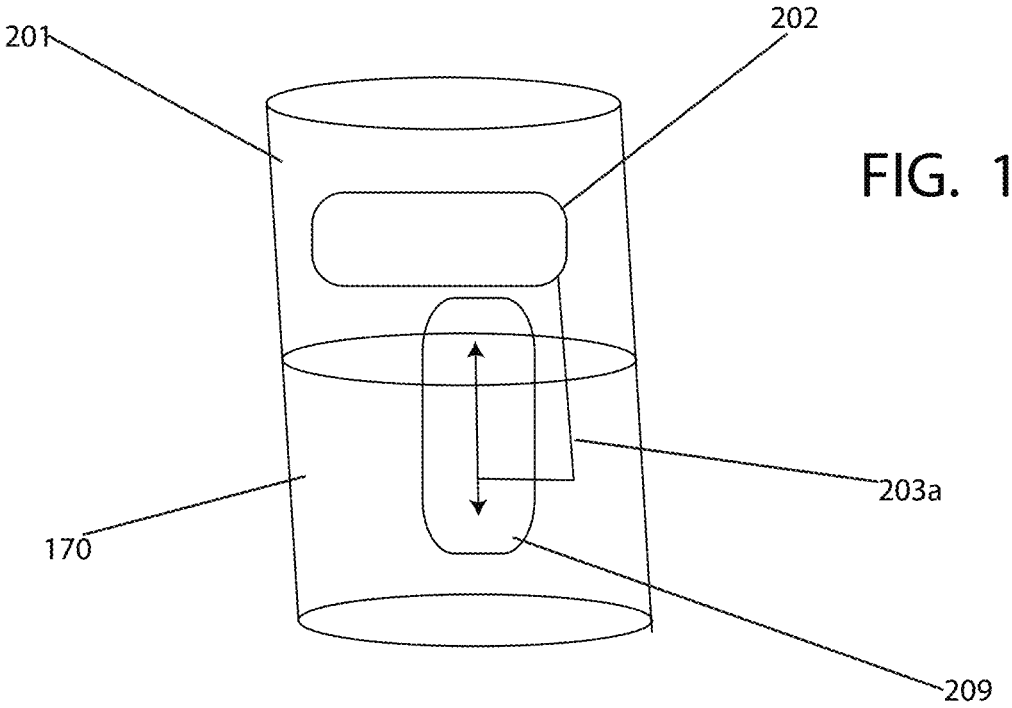
FIG. 11*b* is a side view of another embodiment of the electronic devices.

FIG. 11A is a side transparent view of an electronic cap 201 which houses a controller 202 which is essentially the components of controller 100 but disposed inside of housing or cap 201. Cap 201 is coupled to housing or end section 170. Controller 202 is coupled to a heating element 203 which when triggered by controller 202 heats up fuse 206 so that fuse link 206 that dissolves through passage 207 or otherwise intentionally fails and then causes the spring such as spring 150 to expand driving gear 160 to mesh with adjacent gearing or contoured section 167 to drive or actuate the hinge. FIG. 11B shows an alternative embodiment, wherein controller 202 is coupled via wire 203*a* to a solenoid 209 which is disposed inside of housing or end section 170, wherein solenoid 209 is configured to collapse, thereby allowing spring 150 to expand and rotate, causing gear 160 to mesh with contoured section 167 thereby actuating the hinge.

Figure 12A:
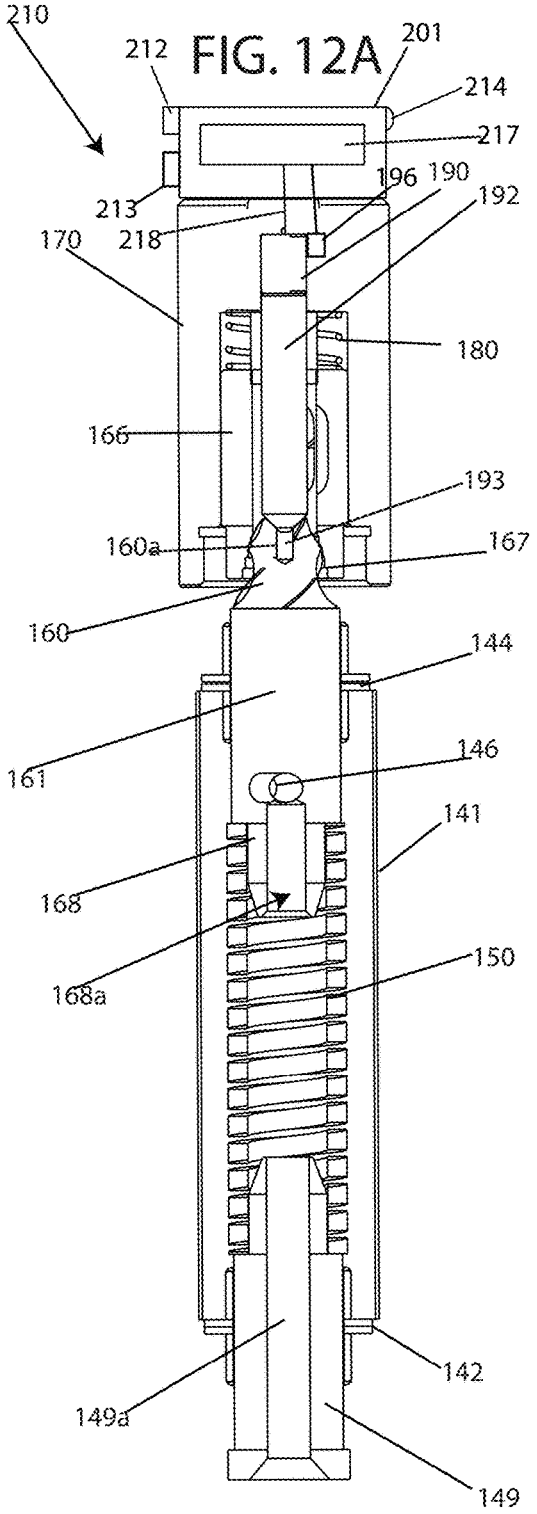
FIG. 12A is a side view of another embodiment.
Figure 12B:
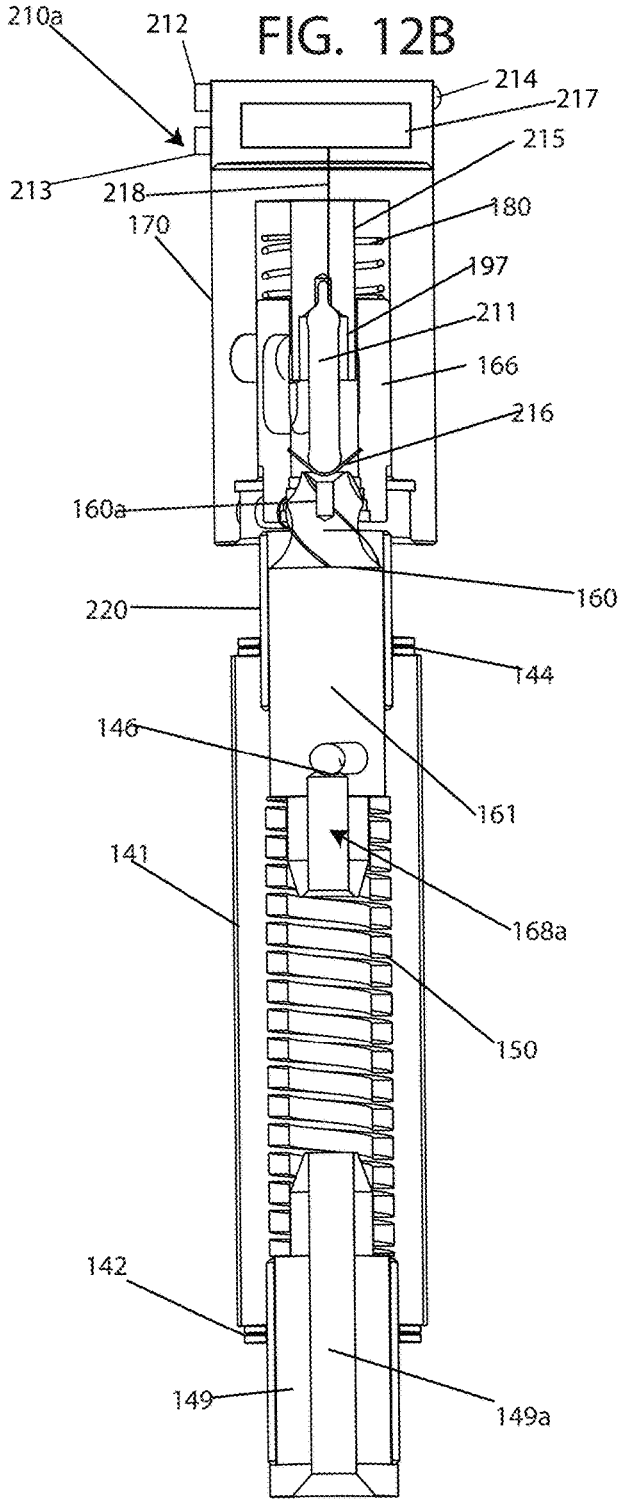
FIG. 12B is a side view of another embodiment.

FIG. 12A is a side cross-sectional view of the embodiment 210 with the hinges 112 and 120 removed while FIG. 12B shows a side cross-sectional view of the second embodiment 210*a* with the hinges 112 and 120 removed.

With respect to FIG. 12A there is shown a end cap 201 which is coupled to housing or end section 170. End cap includes a controller 217 which is essentially controller 100 disposed inside of end cap 201. Controller 217 is electrically coupled to heating element 196. Heating element 196 is configured to be selectively heated by controller 217 to collapse a heatable fuse or collapsible block 190. When heatable fuse or collapsible block 190 is heated it collapses allowing drive pin 192 to be forced up by spring 150 thereby causing gear 160 to mesh with contoured section 167 to actuate the hinge.

As disclosed above, this embodiment includes a head section 170 and a body section 140. The head section 170 includes the drive pin 192 and the electronically collapsible block 190. There is also shown spring 180 as well as receiving element 166. Gear 160 is shown prior to full engagement with the contoured section 167 of receiving element 166. Gear 160 includes opening 160*a* to receive tip 193 of drive pin 192 or bearing cap 160*a* of frangible bulb 211. Bearings 144 are shown positioned adjacent to gear block 161 while pin 146 is shown coupled to gear body 161 as well. Tapered end section 168 has a hollowed out and internally threaded section 168*a* which is left hollow by the removal of bolt 152 (see FIG. 10). Spring 150 is shown which is coupled at one end to tapered end section 68 of the gear, while the opposite end is coupled to block 149 as described above. Bearings 142 are shown while positioned between cover 141 and end block 149. End block 149 includes a hollowed-out section 149*a* which is hollow to receive bolt 152 (See FIG. 10). With the second embodiment, there are a few differences. Collapsible shaft 211 includes bearing surface 216 and is inserted into block 215 which extends down from end section 170. Block 215 and bearing surface 216 encases the collapsible shaft or frangible bulb 211 such that when it is compromised, remnants are contained within. The frangible bulb can be collapsed either through ambient heat or through the heating of a heating element 197 which when controlled by controller 217 heats the frangible bulb above a collapse temperature to cause the frangible bulb to collapse. Additional bearings 144 and 142 are shown with bearings 144 being formed as disc bearings. Bearings 142 are also formed as disc bearings as well. In addition, coupled to the end cap is a microphone 212, a loudspeaker 213, and an indicator light. Loudspeaker 213 or indicator light 214 can also be referred to as an annunciator. Microphone 212 is configured to receive audible instructions for selectively activating the hinge, loudspeaker 213 is configured to convey information to parties near the hinge, and indicator light is configured to provide visual indication of activation of the hinge. These three components are selectively controlled by controller 217.

Figure 13A:
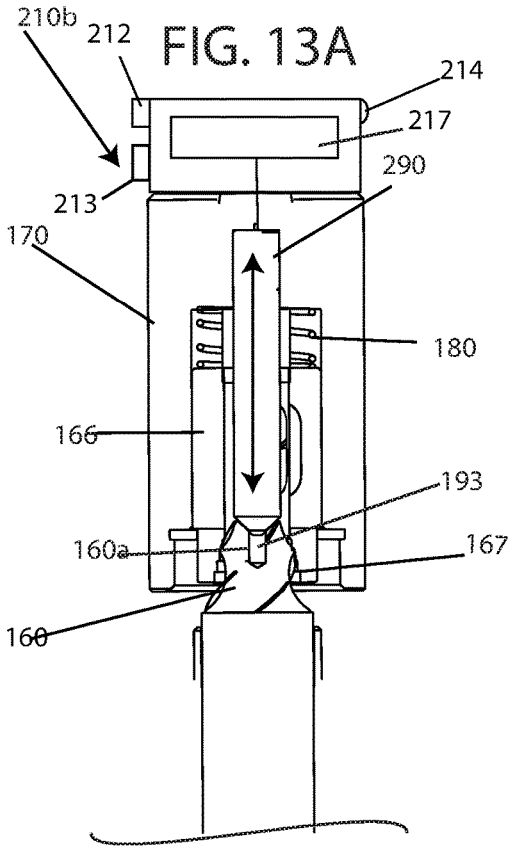
FIG. 13A is a side cut away view of another embodiment.
Figure 13B:
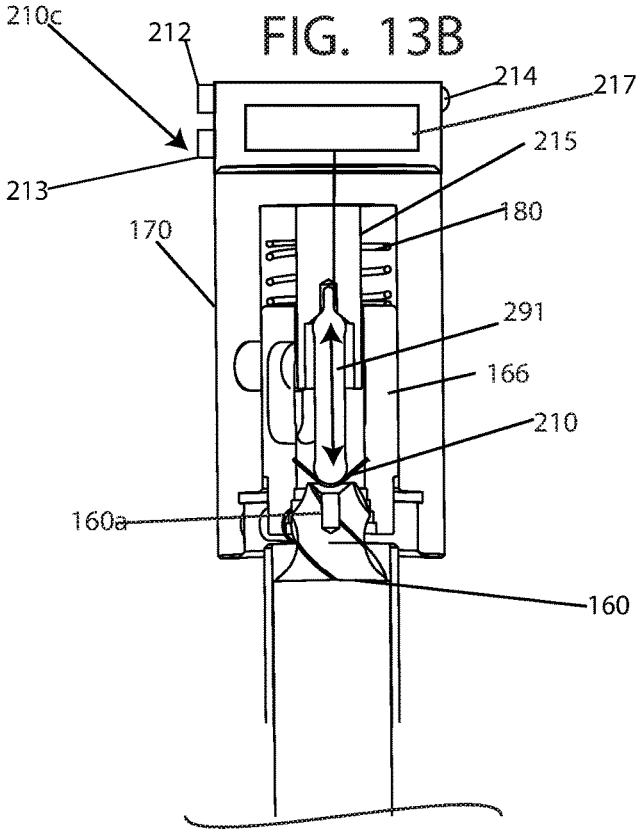
FIG. 13B is a side cut away view of another embodiment.

FIGS. 13 A and 13B show different embodiments than FIGS. 12A and 12B in that FIG. 13A discloses a collapsible block 290 which comprises a solenoid which is configured to selectively collapse when instructed by controller 217. Alternatively, a different collapsible block 291 which is also driven by a solenoid and controlled by controller 217 can be instructed to collapse as well. This then causes gear 160 to be driven by spring 150 (not shown) to cause engagement of gear 160 into contoured section 167 to cause activation of the hinge which results in either selective closure or opening of the hinge.

Figure 13C:
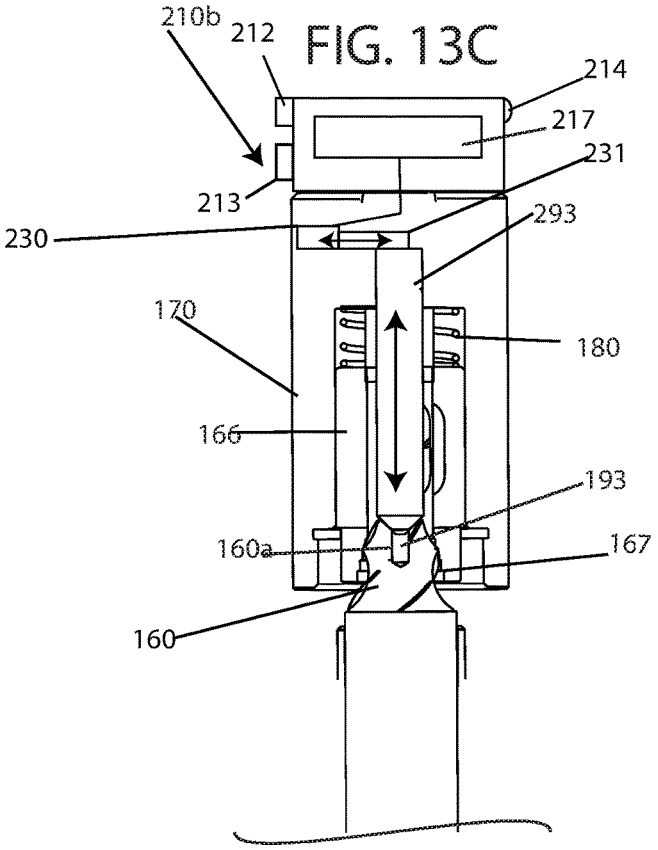
FIG. 13C is a side cut away view of another embodiment

FIG. 13C shows another embodiment which shows controller 217 configured to drive a motor 230 which actuates a locking pin 231. When motor 230 actuates locking pin 231, this draws locking pin into motor thereby clearing a path for an upward movement of block 293 allowing a spring such as spring 150 (See FIG. 9) to drive the block 293 upward thereby allowing for the engagement of gear 160 and the actuation of the hinge.

Figure 14:
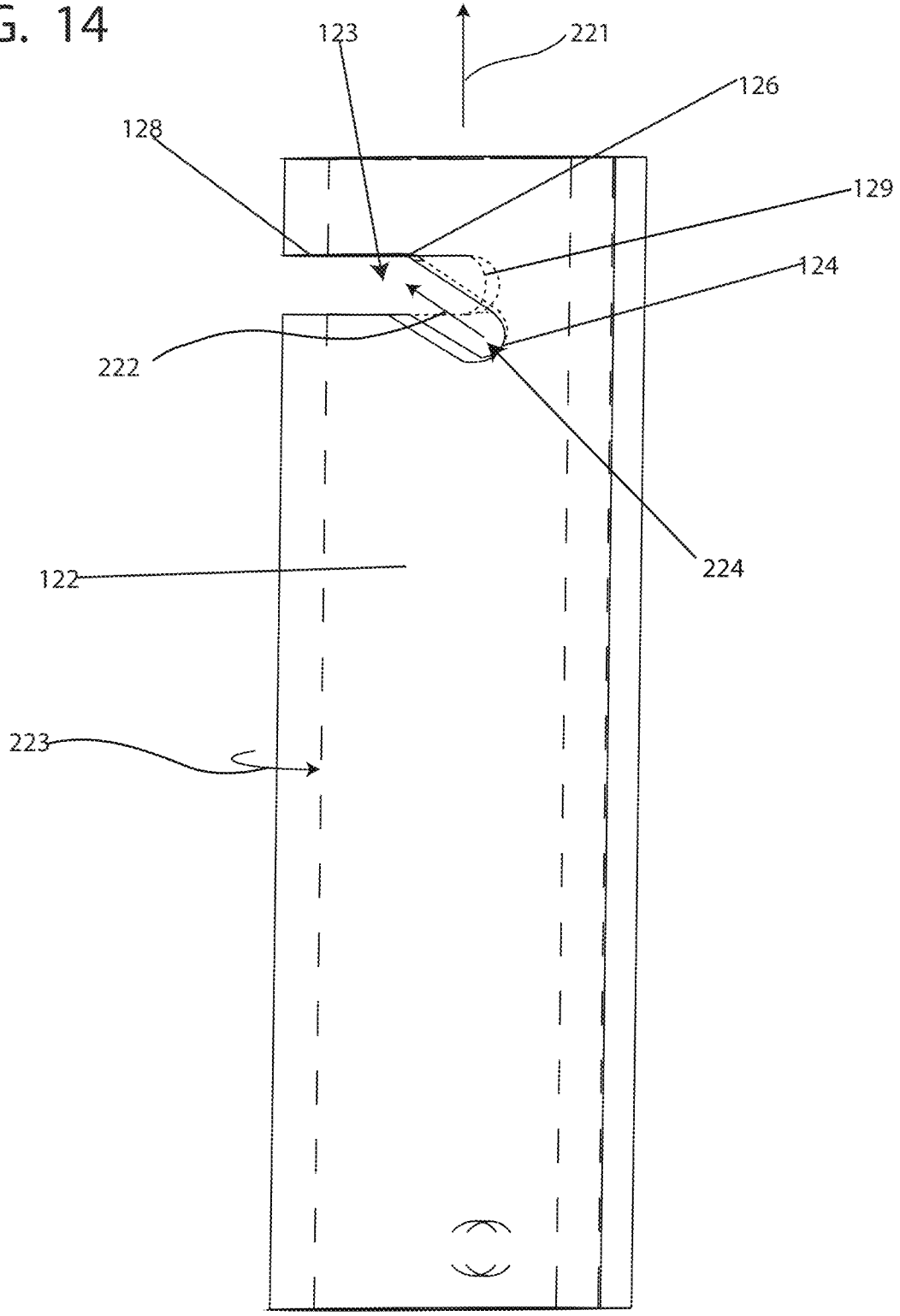
FIG. 14 is a side view of the knuckle.
Figure 15:
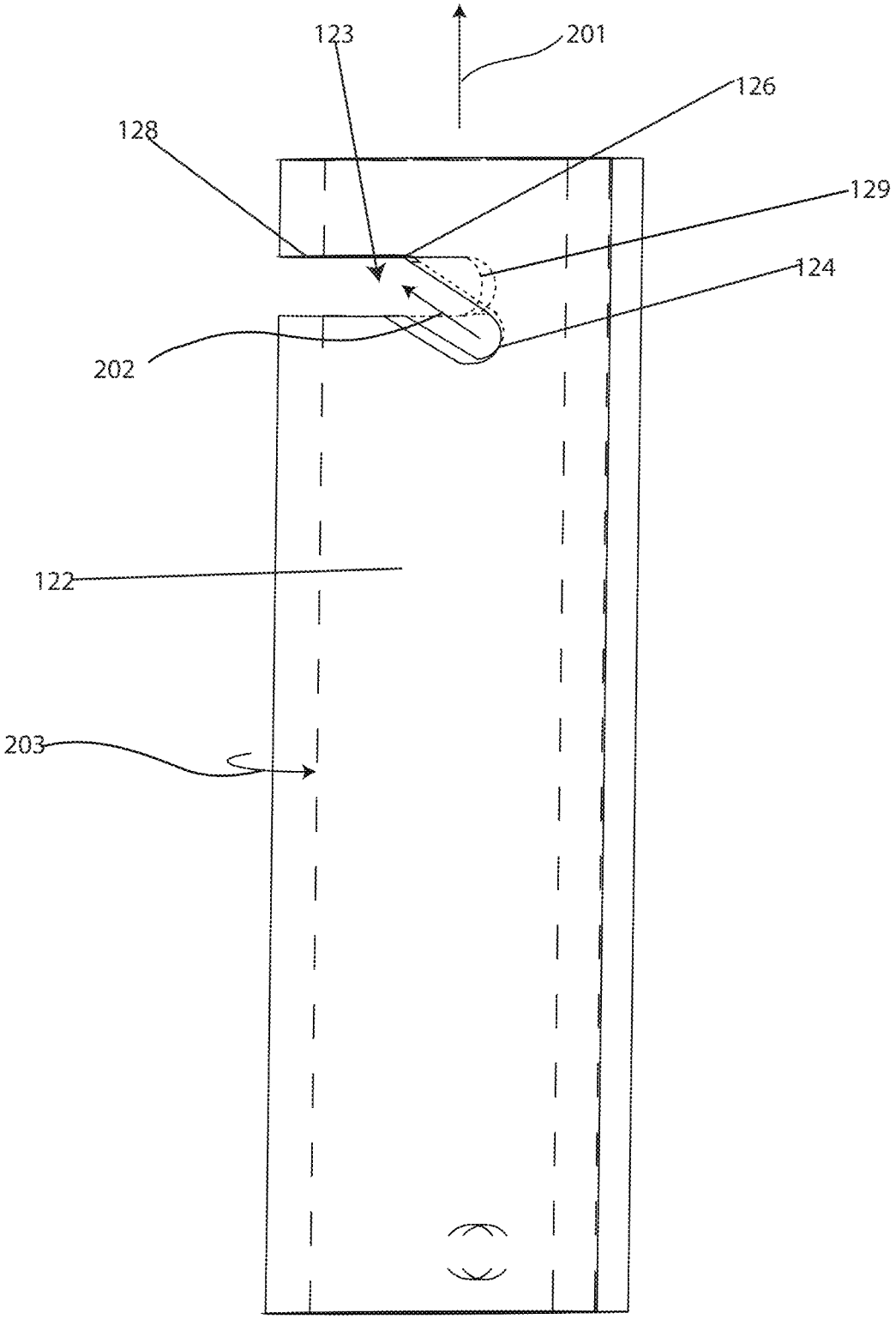
FIG. 15 is a side view of the knuckle.

FIGS. 14 and 15 are a side view of knuckle 122 which includes groove 123 having angled section 124, angle point 126 extending section 128 and an end 129. As shown in FIGS. 11A and 11B the movement of a pin such as pin 146 relative to knuckle 122 is first from point 224 up along angled section 124 in the direction of arrow 222, once the pin 146 reaches an angle point such as angle point 126, knuckle 122 is driven in radial manner along a curve path in the direction of arrow 223. This causes end 129 to move from a first position to a second position. These different positions represent the movement of the pin 146 and/or the knuckle 122 as the fuse or collapsible shaft or drive pin 192 or the frangible bulb or electronically collapsible shaft 211 is collapsed due to an increase in heat. If a fuse or frangible bulb is used, the temperature at which the fuse or the frangible bulb becomes compromised could be any suitable elevated temperature which would indicate an extreme situation such as a fire. For example, the elevated temperature could be at least 120 degrees F., 130 degrees F., 140 degrees F. or any other suitable temperature. The angled rotational movement of pin 46 signifies the angled (partially axially) rotational movement of the gear 160 enmeshing with the contoured region 167 as well. As the gear 160 moves up and rotates it is gradually frictionally turning into the contoured section 167 to enmesh and then lock these two pieces together. As these two pieces are locked together, this provides a fixed end to allow for spring 150 to drive the hinge thereby rotating knuckle 122 and its associated hinge part.

For example, in at least one embodiment, when pin 146 is in position 224, the hinge 112 is in a position wherein the spring is coiled but the hinge 112 is disengaged, with gear 160 not engaged with contoured section 167, this thereby allows the hinge and by extension the door to swing freely. The angled section 124 of the groove 123 forms a block or a lock that keeps the knuckle from rotating relative to the pin 146, by the substantially vertical extension of groove 123 when the hinge is installed. However, in a condition wherein the temperature is elevated, such as at above 120 degrees F., once the fuse or collapsible shaft 190 or the frangible bulb or collapsible shaft 211 is compromised, the worm gear 160 moves vertically up, against for example drive pin 192 due to the coiled pressure exerted by spring 150, and this upward movement along with the uncoiling of spring 150 causes pin 146 to move along arrow 222 to angle point 126.

With gear 160 engaged with contoured section 167, end 150.2 of spring 150 is now fixed to hinge 112, while end 150.1 of spring 150 which is coupled to surface 149*b* (See FIG. 10) causes spring torsion to be exerted between hinges 112 and 120. Because pin 147 is coupled to knuckle 122, this drives knuckle 122 to rotate and thereby actuate the door. Thus, further uncoiling of spring 150 results in knuckle 122 rotating as shown by arrow 223 from a first position to a final position along rotational path 223 thereby actuating the door.

In an alternative embodiment the frangible bulb or collapsible shaft 211 is used instead of fuse or collapsible block 190 and drive pin 92. The movement is therefore similar to that described above.

Figure 16:
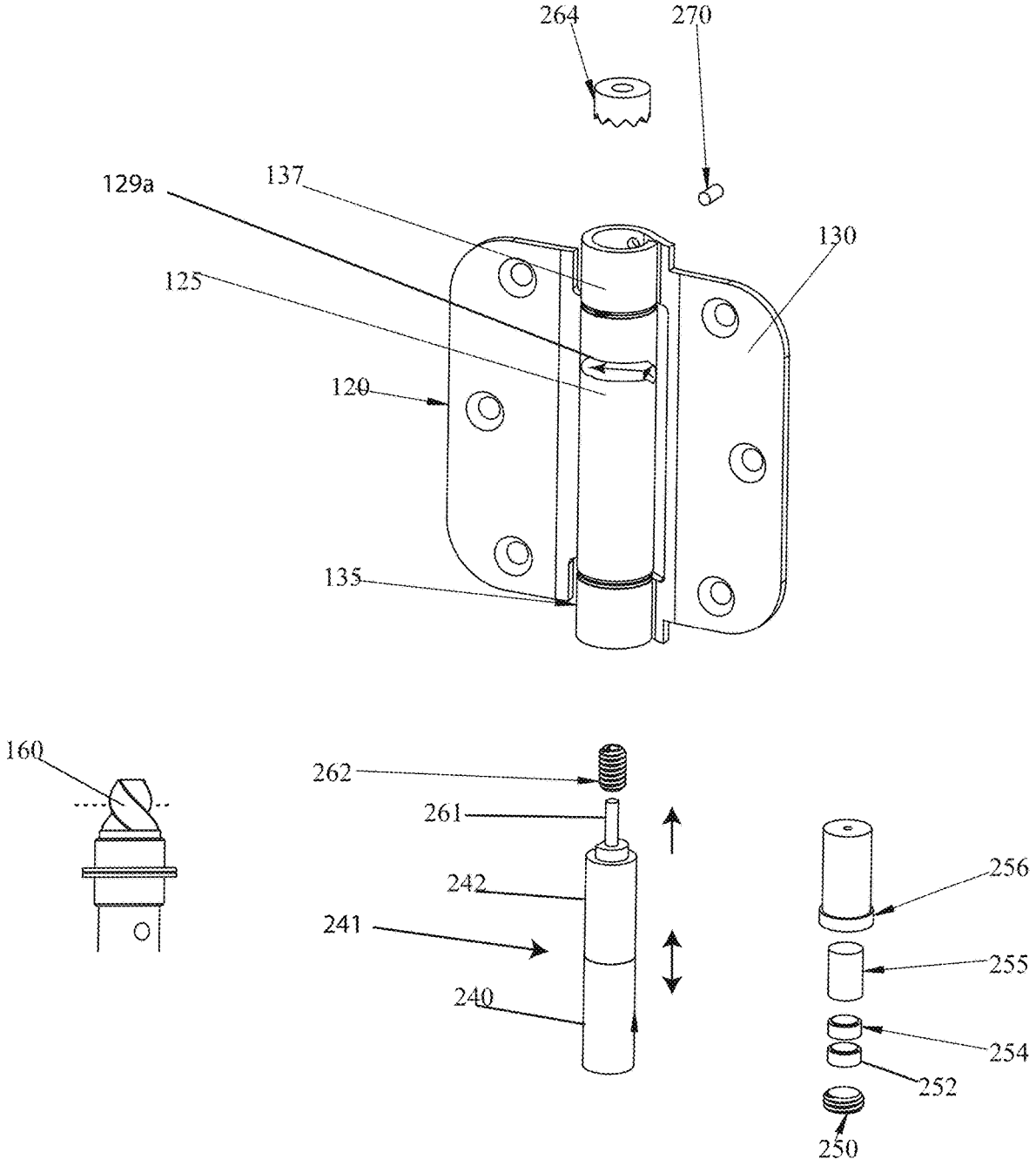
FIG. 16 is a perspective view of another embodiment.

FIG. 16 shows another alternative embodiment which shows hinges 120 and 130 coupled together. Hinge 120 has knuckle 125 which has an angled slot 129*a* disposed therein. This angled slot 129*a* is similar to that disclosed above. Hinge 130 has knuckles 135 and 137. There is an electronic drive comprising two separate blocks 240 and 242 which create a drive that is upward driving worm gear 160 up along with a pin that resides inside of slot 129*a*. The upward drive motion created by a solenoid drive or motor driven worm gear disposed inside of blocks 242 and 240 results in these blocks separating and driving pin 261 and gear 262 upward into worm gear 160. This drives worm gear 160 up in an upward rotating motion. Worm Gear 160 then locks with corresponding gear 264 disposed in knuckle 137. Gear 264 is locked via pin 270 in knuckle 137. This locking causes the drive comprising drive blocks 240 and 242 to drove hinge 130 to rotate vs hinge 120 to either open or close the hinge.

The drive 241 comprising drive blocks 240 and 242 can be powered by a transceiver block and power block 255 housed in a lower housing 256. Inside of lower housing are also batteries 254 and/or 252 which are secured by a screw 250. Alternatively. Transceiver and power block 255 is also configurable to receive direct electrical wiring as well. Transceiver and power block 255 is configured to communicate with the network shown in FIG. 4.

Accordingly, while at least one embodiment of the present invention have been shown and described, it is to be understood that many changes and modifications may be made thereunto without departing from the spirit and scope of the invention as defined in the appended claims.

What is claimed is:

1. A compact hinge actuating device comprising:

a hinge comprising a first hinge plate having a first knuckle and a second hinge plate having a second knuckle;

a sensor coupled to said hinge;

a microprocessor coupled to said hinge;

a drive extending within said first and second knuckles, said drive comprising a motor and a Bendix shaft; and a dog clutch having a first drive dog fixed to one of the first and second knuckles and a second drive dog connected to the Bendix shaft;

wherein when said sensor receives input of a predetermined condition, and said microprocessor reads said input as exceeding a predetermined threshold value of the predetermined condition, said microprocessor triggers said drive to actuate said hinge.

2. The device as in claim 1, further comprising memory for storing the predetermined threshold value of the predetermined condition.

3. The device as in claim 1, further comprising a transceiver for allowing communication from said microprocessor to other electronic devices.

4. The device as in claim 1, wherein said hinge is configured to be coupled a door and to a frame wherein said drive on said hinge is configured to actuate said hinge to move said door when said microprocessor reads said input as exceeding the predetermined threshold value of the predetermined condition.

5. The device as in claim 1, wherein said sensor is one of an audio sensor, a heat sensor and a smoke sensor.

6. The device as in claim 1, wherein the drive further comprises, a gearbox, wherein said motor is configured to engage said gearbox to selectively activate the hinge.

* * * * *